United States Patent [19]

Koch et al.

[11] Patent Number: 4,936,824

[45] Date of Patent: Jun. 26, 1990

[54] INFANT INCUBATOR WITH AIR CURTAIN

[75] Inventors: Robert J. Koch; Anthony D. Buttitta, both of Ellicott City, Md.

[73] Assignee: The BOC Group, Inc., New Providence, N.J.

[21] Appl. No.: 50,593

[22] Filed: May 15, 1987

[51] Int. Cl.[5] ..... A61G 11/00

[52] U.S. Cl. ..... 600/22; 128/205.26

[58] Field of Search ..... 128/1 B, 205.26

[56] References Cited

U.S. PATENT DOCUMENTS

| | | | |
|---|---|---|---|
| 2,292,120 | 8/1942 | Hanby | 128/1 B |
| 3,158,150 | 11/1964 | Croasdaile | 128/1 B |
| 3,387,600 | 6/1968 | Terzian . | |
| 3,511,162 | 5/1970 | Truhan . | |
| 3,529,590 | 9/1970 | Grosholz | 128/1 B |
| 3,782,362 | 1/1974 | Puzio . | |
| 3,821,947 | 7/1974 | Schossow . | |
| 4,221,211 | 9/1980 | Brasch | 128/1 B |
| 4,321,913 | 3/1982 | Maluta et al. | 128/1 B |
| 4,361,137 | 11/1982 | Grosholz | 128/1 B |
| 4,423,669 | 1/1984 | Bullock et al. | 98/36 |
| 4,617,912 | 10/1986 | Beer et al. . | |
| 4,750,474 | 6/1988 | Dukhan | 128/205.26 X |
| 4,846,783 | 7/1989 | Koch et al. | 600/22 |

FOREIGN PATENT DOCUMENTS

| | | |
|---|---|---|
| 102667 | 9/1987 | European Pat. Off. . |
| 2061704 | 7/1979 | Fed. Rep. of Germany . |
| 3446365 | 4/1985 | Fed. Rep. of Germany . |
| 3607575 | 10/1987 | Fed. Rep. of Germany . |
| 2175213 | 11/1986 | United Kingdom . |

OTHER PUBLICATIONS

Brochure Amelette Incubator–Ameda Co., Switzerland, Copyright 1985.

Atom Co., Ltd., Atom Infant Incubator–Model v–82/SC with Air Curtain, May 1985.

*Primary Examiner*—Leonard E. Smith
*Assistant Examiner*—Eugene L. Szczecina, Jr.
*Attorney, Agent, or Firm*—Roger M. Rathbun; Larry R. Cassett

[57] ABSTRACT

An infant incubator is disclosed having a hood that encloses the infant compartment. In the base of the incubator is the heating air and ducting means and which provides heated through an ever open outlet in the base and which heated air passes from the base through a flow path formed by the hood that circulates around the infant and re-enters the base through an inlet. That heated air is thus introduced into or along the access door in the front of the hood from the outlet and travels through or along the access door and through or along the hood around the infant and is returned to the base for recirculation. The hood itself is pivotally attached to the base at the rear of the incubator so that it can be opened from the front for complete access to the infant. The access door in the front of the hood is pivotally attached to the incubator base and can also be opened for access to the infant. When the access door is in its closed position, it forms part of the air path for the heated air. The heated air from the access door continues to pass along the flow path formed by the hood. When the access door is opened, it pivots out of the way of the air flow from the ever open outlet in the base and the flow of heated air continues over the area normally occupied by the access door when in its closed position forming an air curtain to protect the environment of the infant compartment. The flow of air thereafter enters the flow path formed by the hood in the same manner as the path of the air flow when the access door is closed and eventually re-enters the base through the inlet.

5 Claims, 6 Drawing Sheets

INFANT INCUBATOR WITH AIR CURTAIN

BACKGROUND OF THE INVENTION

This invention relates to the field of infant incubators and, specifically, to an improved incubator having a unique hood design with an access door for obtaining convenient access to the infant while minimizing disruption to the heated environment in which the infant is located.

Incubator hoods, in general, form the enclosure about an infant and contain within, the unique environment which the infant requires. Since that environment is a heated and humidified atmosphere, it is important that heat be efficiently transmitted to the internal infant compartment and be easily regulated to be maintained within rather precise limits. Additionally the incubator hood must provide ease of access to the infant so that attending personnel can readily reach the infant without a great deal of difficulty and, optimally, without causing great changes to that internal controlled environment.

Typical of some incubators, is the double hood design where the hood itself is made up of two transparent walls that are designed to lie adjacent one another and which thereby form a passageway within the hood through which heated air can pass. One of such hoods is shown and described in U.S. Pat. No. 4,321,913 of Maluta et al. The double hood provides heat retention and controlability and its advantages are amply set forth in the aforedescribed patent.

The hood design of Maluta et al. is, however, fairly complex in its design and manufacture and a large opening is needed for access to the infant. One solution to the problem of heat loss when any opening is affected to reach the infant has been proposed by the formation of an air curtain that flows heated air generally across the open area. An example of such means is described in U.S. Pat. No. 4,361,137 of Grosholz and which shows an access door that, when opened, causes a normally closed passageway to open to emit warm air across the door area. In Grosholz, however, a mechanism is employed to open and close that passageway with the access door. In addition, the flow of warmed air of Grosholz passes laterally from end to end about the infant compartment and about the infant. Its normal flow path is therefore abnormal to the flow path needed to form the air curtain.

SUMMARY OF THE INVENTION

The present invention provides an improved incubator having a unique air flow path that may be used with a double wall hood design or with a more conventional hood, and has an access door in that hood. When the access door is opened, the air flow path continues basically along the same flow path for the flow of air circulated around the inside of the hood to form an air curtain across the area normally occupied by the closed access door.

The hood is capable of being completely opened for full access by being pivotally connected to the incubator base at the rear thereof. Air flow regularily passes around the hood from front to back, that is, the path of heated air passes around the infant and is continuously circulated within or along the walls of the hood. When a double wall hood is used, a portion of the heated air circulating through the hood is caused to directly enter the infant compartment. The access door is also pivotally connected to the incubator base such that when opened, it swings clear of the normal path of heated air and that heated air continues from the same continuously open outlet from the base and is directed across the area formerly occupied by the access door. Thus, no valves or baffles are needed to change the flow of heated air when the access door is opened, and the same flow of heated air around the infant is continued through either the internal passage of the double hood or around the inside surface of the single wall hood by formation of a boundary layer.

Other features of the incubator will become more apparent in light of the following detailed description of a preferred embodiment thereof and as illustrated in the accompanying drawings.

DESCRIPTION OF THE PREFERRED EMBODIMENT

Figure 1:
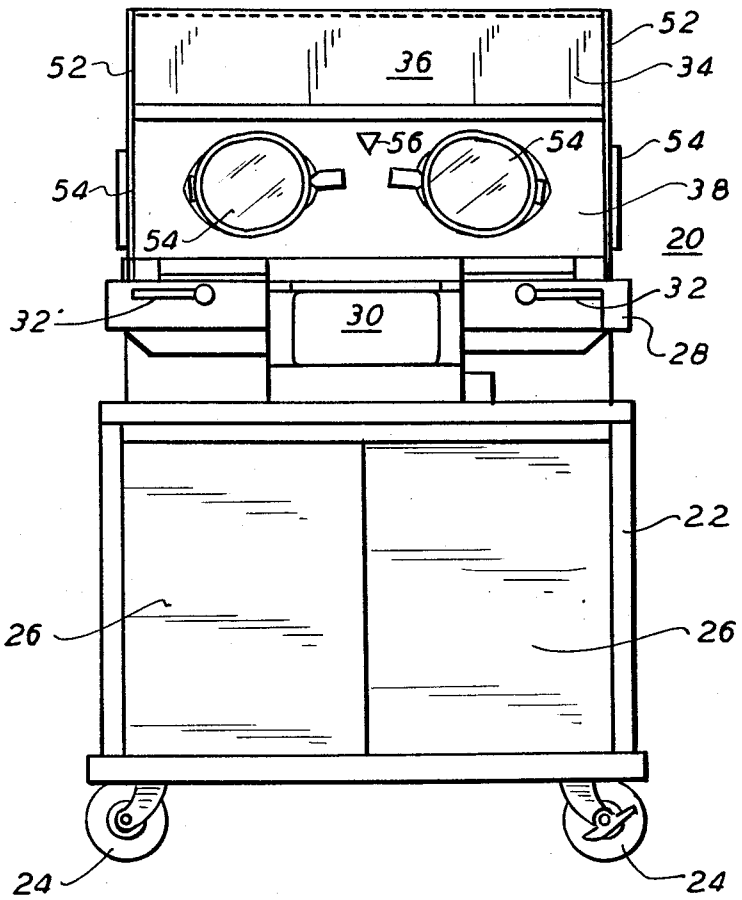
FIG. 1 is a front view of an incubator constructed in accordance with the present invention, and including a double wall hood design.

Referring now to FIG. 1 there is shown an infant incubator 20 mounted upon a base cabinet 22. The base cabinet 22 provides support for infant incubator 20 at the appropriate height and may include wheels 24 so that the infant incubator 20 can be easily moved from one position to another. The base cabinet 22 may contain a storage facility for holding products for attending to infants and, as shown, doors 26 are provided for access to that storage area.

Infant incubator 20 includes a base 28, preferably of a rigid structural material including aluminum or a plastic such as polycarbonate. The base 28 seats upon base cabinet 22 and contains much of the functioning mechanism for operation of the infant incubator 20 as will be later explained.

Base 28 may also include control panel 30 where controls are located for operating the incubator. Such controls may include temperature settings, temperature read-out, alarm limits and the like and which do not form a part of the present invention. Levers 32 may also be a part of base 28 and are usable to adjust the tilt position of the infant bed (not shown).

Figure 2:
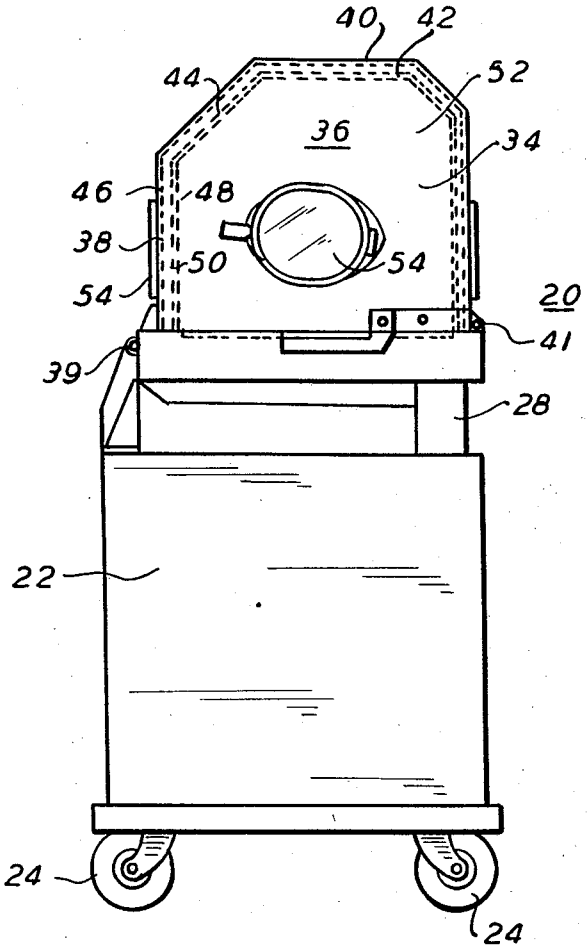
FIG. 2 is a side view of the incubator of FIG. 1.

A hood 34 overlies base 28 and encloses therein an infant compartment 36. As shown in FIGS. 1 and 2, hood 34 is of a double wall construction, however, as will be noted, a single wall hood embodiment is also applicable with the subject invention. Hood 34 is of a transparent material, preferably plexiglass and has an access door 38 for the attending personnel to gain ready access to the infant. Turning to both FIG. 1 and FIG. 2, the access door 38 can be seen to be pivotally connected to base 28 by means such as pins 39 or, other alternate pivoting means could be employed, including piano type hinges. As noted specifically in FIG. 2, however, the pivot means or pins 39 are offset from the base of the access door 38 such that the pivot point causes the access door 38, when open, to be displaced from its normal position as will be explained.

Hood 34 itself is pivotally connected to the base 28 at the rear of incubator 20 by means such as pivots 41 such that the entire hood 34 may be opened, yet the access door 38 will not move with hood 34 as hood 34 is opened since access door 38 is affixed to base 28 and not to hood 34.

The hood 34 is of a double wall design in FIGS. 1 and 2 and therefore includes an outer wall 40 and an inner wall 42 spaced a predetermined distance therefrom and thereby forming an air passage 44 between the outer wall 40 and inner wall 42.

Likewise, the access door 38 is of a double wall construction having an outer wall 46 and an inner wall 48, also forming an air passage 50 therebetween. As noted in FIG. 2 specifically, the air passage 50 of access door 38 aligns, when in its closed position, with the air passage 44 in hood 34 and forms a continuous path for the flow of heated air that circulates from the front of the incubator 20, over and around the infant, to the rear of incubator 20. As will be later noted, some heated air is also introduced into the infant compartment 36 by openings (not shown in FIGS. 1 or 2) in the inner wall 48 of access door 38. The side walls 52 of hood 34 are single walls of a transparent material.

Other features of hood 34 include handholes 54 of conventional design for the attending personnel to have access to the infant without opening any larger openings to the infant compartment 36. A latch 56, also of conventional design is provided for opening and closing access door 38.

Figure 3:
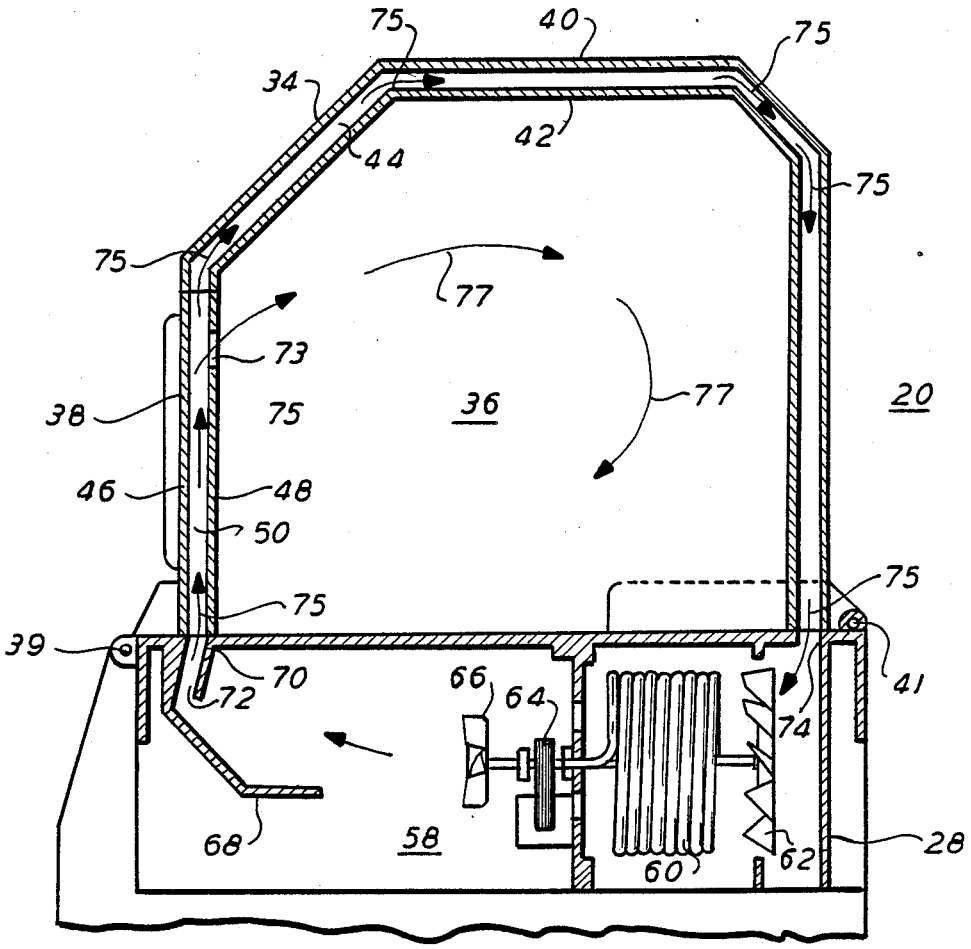
FIG. 3 is a side cross-sectional view of an incubator incorporating the present invention showing its access door closed and illustrating the flow path of the heated air through a double wall hood.

Turning now to FIG. 3, there is shown a side cross-sectional view of the incubator 20 and illustrating the path of heated air when access door 38 is closed and when the double wall hood construction of FIGS. 1 and 2 is utilized.

A heater compartment 58 is contained within base 28 and contains the means to heat and circulate that heated air through hood 34 to heat infant compartment 36. The actual means to provide such heat and circulation of the heated air may comprise a conventional heater 60 and a fan 62 that induces the air past heater 60 to heat the air which then enters the remaining portion of heater compartment 58. A fan motor 64 with a cooling fan 66 is used to power fan 62. The heated air that passes from heater 60 is directed by means such as a baffle 68 toward an ever open outlet opening 70 in the base 28 and through which the heated air passes to enter the air passage 50 formed in access door 38. As can be seen, the channel 72 leading the heated air though outlet opening 70 is directed slightly inwardly toward the infant compartment 36 at an angle of between about 5 and 20 degrees from a plane extending vertical upwardly from the base 28 and aligned with outlet opening 70.

As can further be seen in FIG. 3, the heated air flows through the air passage 50 between outer wall 46 and inner wall 48 in access door 38 and thereafter directly enters and passes through air passage 44 formed in hood 34 between outer wall 40 and inner wall 42. Eventually the heated air passes through the rear of hood 34 and enters the heater compartment 58 through an inlet opening 74 in base 28 formed along the rear of infant compartment 36. Thus the heated air circulates in a circular pattern around the infant compartment 36 from front to rear within the double walled hood 34 as depicted by arrows 75.

In addition, heated air enters infant compartment 36 through openings 73 in inner wall 48 of access 38 as depicted by arrows 77.

Figure 4:
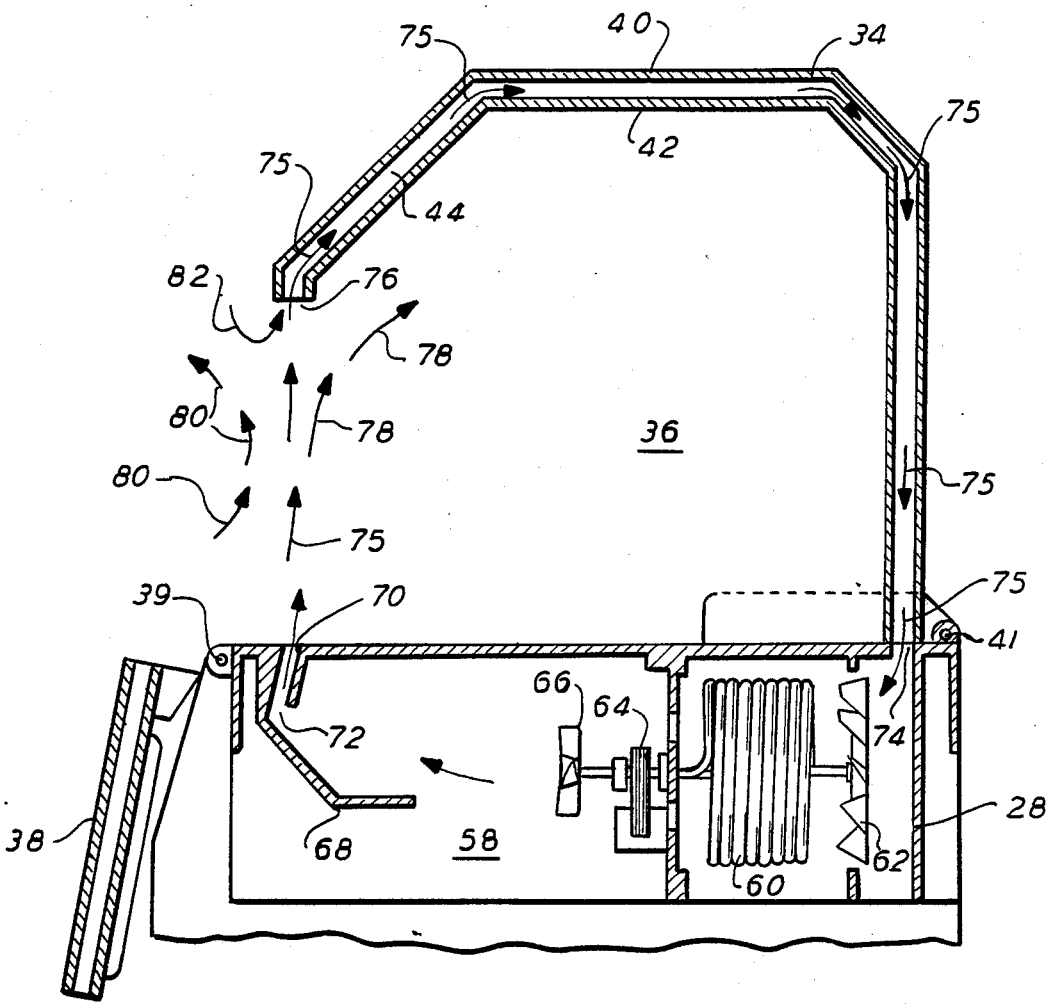
FIG. 4 is a side cross-sectional view of an incubator incorporating the present invention showing its access door in the open position and illustrating the flow of air forming an air curtain with a double wall hood.

Turning now to FIG. 4, there is shown a side, cross-sectional view of the incubator 20 with the double wall hood design and having its access door 38 in the open position. As seen in the FIG. 4, the flow of heated air is directed by the baffle 68 through ever open outlet opening 70 and again, as noted, the direction of air flow through outlet opening 70 is slightly angled inwardly toward infant compartment 36. Since the pins 39 about which access door 38 pivots are displaced outwardly from the plane of access door 38 when in its closed position, the access door 38 moves clear of outlet opening 70 so as not to obstruct the flow of heated air therefrom.

As noted by the arrows 75, however, the heated air forms an air curtain across the area formerly occupied by access door 38 and thereafter the heated air enters the downwardly directed opening 76 of air passage 44 formed between inner wall 42 and outer wall 40 of hood 34 and hence again circulates, as indicated by further arrows 75 through the rear of hood 34 to enter and pass through the heater compartment 58.

A portion of the heated air forming the air curtain, shown by arrows 78 passes inwardly of the downwardly directed opening 76 and proceeds into the infant compartment 36 and, with that flow of heated air, a certain amount of ambient air is induced into the infant compartment 36, however, most of the ambient air, shown by arrows 80 is repelled by the air curtain and thus the ambient air, to the most extent is protected from entering infant compartment 36. As noted by arrow 82, some minor amount of ambient air is also induced into downwardly directed opening 76 of air passage 44 and is thereafter circulated through the incubator 20 in normal air pattern. The inducing of that minor amount of ambient air is not undesirable as some outside ambient air is needed to be added to the recirculating flow of heated air around the infant. Other outside ambient air is induced into the flow stream of air by the fan 62 through an inlet (not shown).

Figure 5:
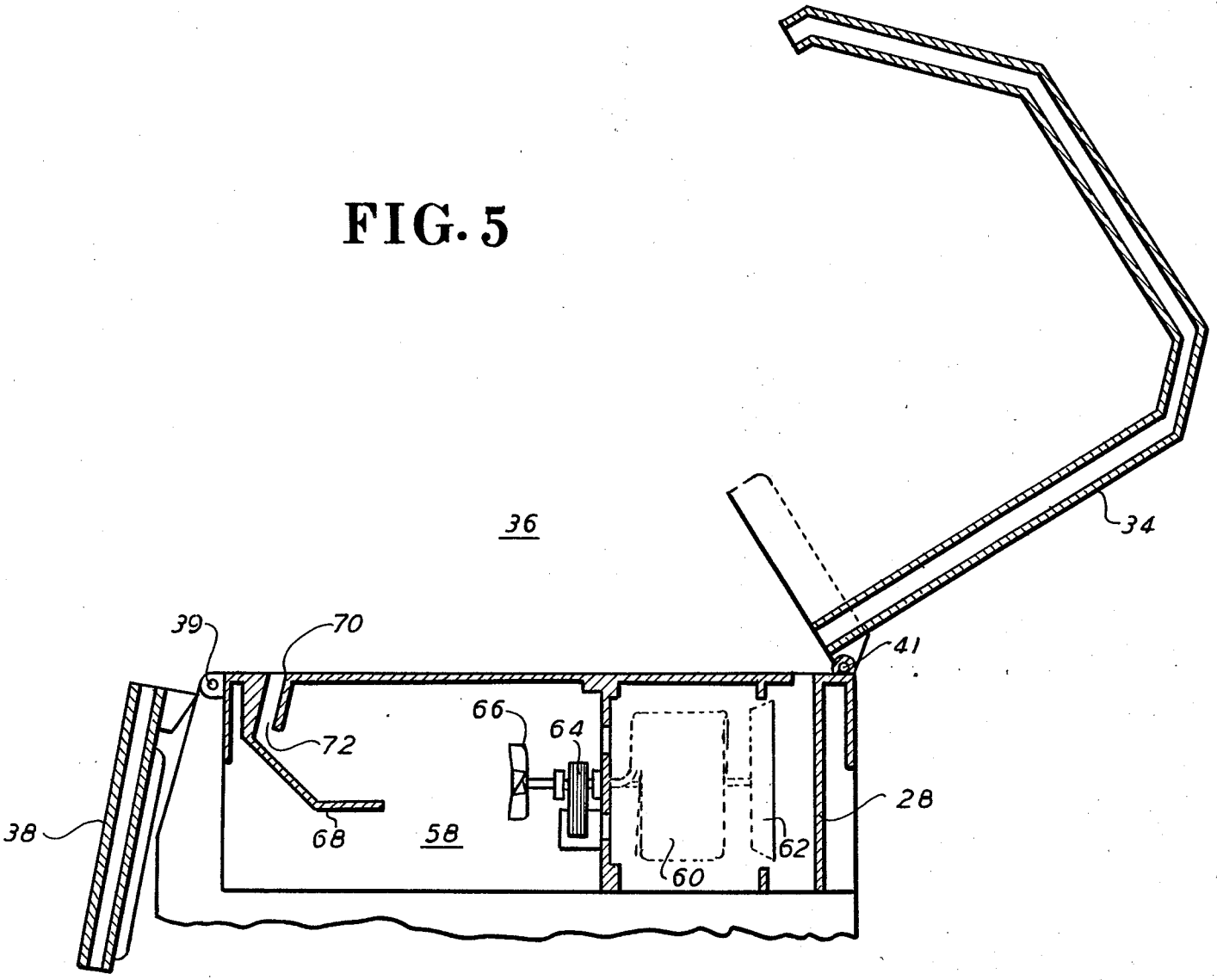
FIG. 5 is a side cross-sectional view of an incubator incorporating the present invention with the entire double wall hood opened.

In FIG. 5, there is shown a side cross-sectional view of the incubator 20 with its hood 34 in the fully open position thereby providing complete access to the infant compartment 36. The access door 38 does not, however, open with hood 34 as the hood 34 rotates open about the pivot 41 since access door 38 is solidly affixed to base 28. When hood 34 is raised, therefore, access door 38 does not hang down or depend from hood 34 but is moved clear thereof.

Figure 6:
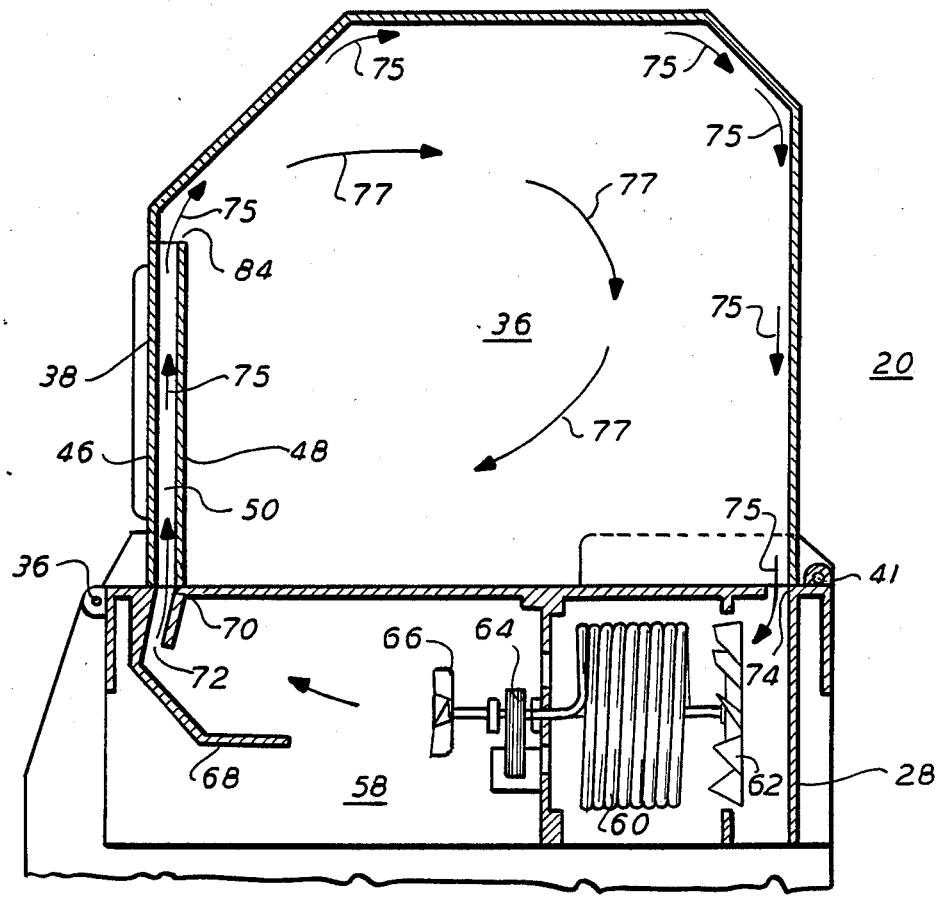
FIG. 6 is a side cross-sectional view of an incubator incorporating the present invention in FIG. 3 utilizing a single wall hood.

Turning now to FIG. 6, there is shown a side cross-sectional view of the incubator 20 having its access door 38 in the closed position and having a single wall constructed hood 34 enclosing infant compartment 36. As shown, access door 38 is still of a double wall construction including outer wall 46 and inner wall 48 forming air passage 50 therebetween, however, the infant incubator 20 of the present invention can be made with but a single wall access door 38 in the same spirit. In the event a single wall access door 38 is utilized, the flow of heated air still follows approximately the same path. By boundary layer effect, the heated air maintains a path generally along the inner wall surfaces, whether that inner surface be of access door 38 or the inner surface of hood 34.

In FIG. 6, therefore, the heated air from heater compartment 58 is directed by baffle 68 toward and into channel 72 and through even open outlet opening 70 into the air passage 50 in access door 38.

Heated air exits the air passage 50 in access door 38 through upwardly directed opening 84 and into infant compartment 36. By boundary layer effect, however, the heated air continues to follow the inner surface of hood 34 and travels in accordance with arrows 75 around the infant and re-enters the heater compartment 58 through inlet opening 74. In addition, some flow of heated air does enter more fully into infant compartment 36 as depicted by arrows 77. The flow of heated air thus is in the same general path as with the double walled hood construction of FIGS. 1–5, that is, it proceeds from front to rear and travels over and around the infant contained within infant compartment 36, with a portion of the heated air directly surrounding the infant.

Figure 7:
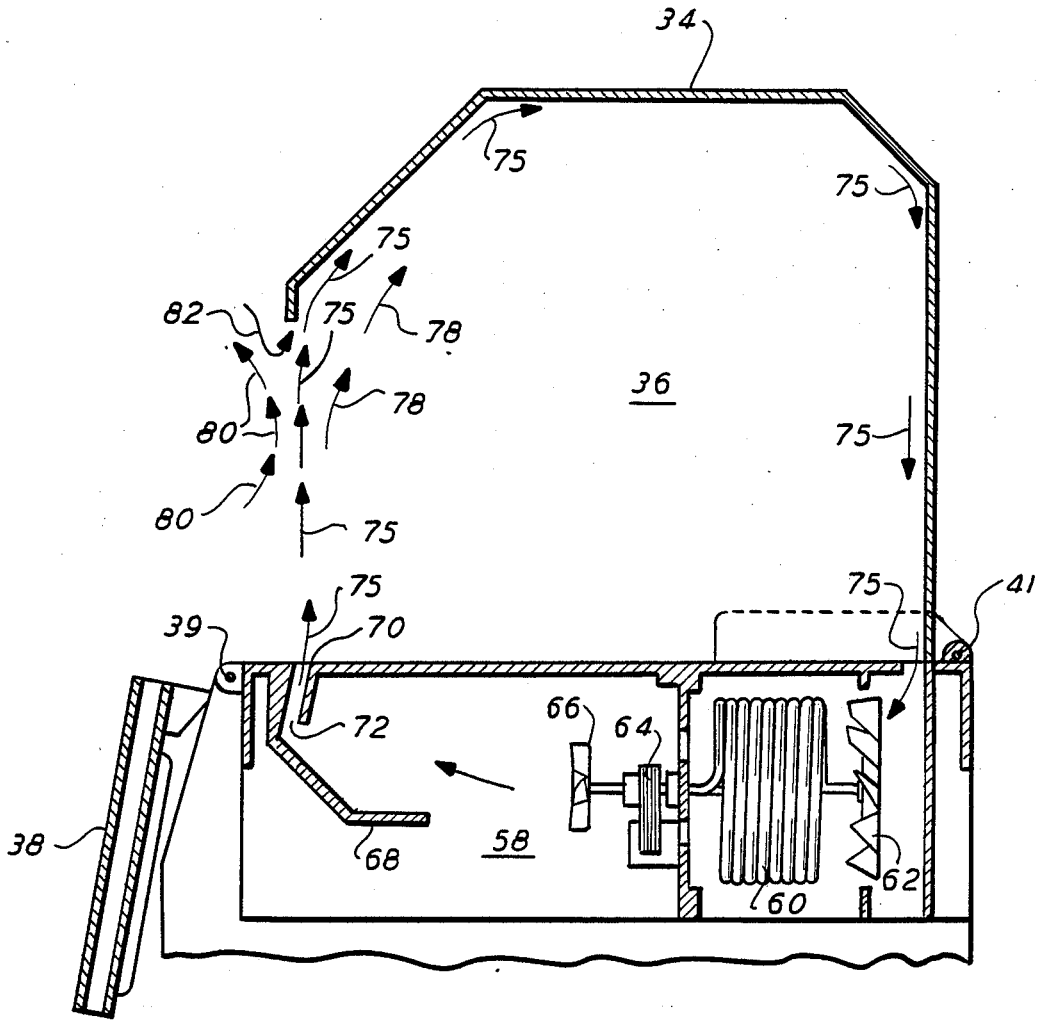
FIG. 7 is a side cross-sectional view of the embodiment of FIG. 6 with the access door in the open position illustrating the flow of air forming an air curtain.

Turning finally to FIG. 7, there is shown a side cross-sectional view of the incubator 20 with its access door 38 in the open position pivoted about pin 39. Again, as may be seen, the path of the flow of heated air from heater compartment 58 follows arrows 75 and forms an air curtain throughout the area occupied by the access door 38 when in its closed position. A portion of the heated air still passes inwardly into the infant compartment, shown by arrows 78 and again, the air curtain repels to the greatest extent, the majority of ambient air, shown by arrows 80. A portion of ambient air is again drawn into infant compartment as depicted by arrows 82, however, as noted, a certain amount of ambient air is desirable, and is normally induced by the fan 62 as make-up air to the flow of air circulating through incubator 20.

It will be understood that the scope of this invention is not limited to the particular steps or materials disclosed herein, by way of example, but only by the scope of the appended claims.

We claim:

1. An infant incubator having a front and a rear for containing an infant comprising:

a base section having an infant support adapted to underlie and support an infant;

a hood mounted to said base section and having double walls, spaced apart, covering the infant; said hood forming a continuous flow path between said double walls for circulating air from the front of said incubator to the rear of said incubator around the sides of the infant; means to mount said hood to said base section to allow opening and closing of said hood to access the infant contained within said hood;

heating and ducting means in said base section, said heating and ducting means having an outlet at the front of said incubator for introducing heated air into the flow path formed by said double walls of said hood and having an inlet at the rear of said incubator for receiving air after circulating through said flow path, said heating and ducting means further including a blower to force said heated air from said outlet into said flow path at a positive pressure and to induce said air from said flow path through said inlet at a negative pressure;

a double wall access door in said hood having an open position affording access to the patient and a closed position wherein said access door receives the heated air from said heating and ducting outlet to pass through said double walls to form a part of the flow path for the heated air;

said access door being pivotally mounted to said base section about a point offset to said outlet to become removed from the normal flow path of heated air from said outlet when said access door is in its open position such that the flow path continues from said outlet under positive pressure across the opening occupied by said door in its closed position and induced into the flow path in said double wall hood to form an air curtain thereacross and then continues along the flow path formed by said double wall hood.

2. An infant incubator as defined in claim 1 wherein said outlet directs the flow of heated air into said flow path at an angle with respect to the vertical of between about 5 and 20 degrees inwardly toward said infant.

3. An infant incubator comprising:

a base section having an infant support adapted to underlie and support an infant, a hood mounted to said base section and having a front wall, a top wall and a rear wall, and lateral side walls, said hood comprising interior and exterior walls in said front, top and rear walls in close proximity thereto forming a continuous flow path for gas through said hood and around the sides of the infant, said hood having said rear wall pivotally mounted to said base section for opening and closing said hood to access the infant contained therein, an access door in said front wall of said hood, said access door having interior and exterior walls in close proximity thereto forming a path for gas through said access door and being pivotally mounted to said base section to an open position affording access to the infant and a closed position wherein said access door comprises a part of said flow path;

heating, air moving and ducting means in said base section for forcing heated air to said flow path in said front wall of said hood including through said access door when said door is in its closed position, said heated air thereafter passing through said top wall and said rear wall of said hood, said heating, air moving and ducting means inducing said heated air from said flow path in said rear wall to said base section.

said access door being pivotally mounted such that when in its open position it is removed from the flow path of heated air from said base section such that said heated air is forced across the opening normally occupied by said door in its closed position to form an air curtain and said heated air from the air curtain thereafter is induced into the flow path within said hood to pass through said walls of said hood.

4. An infant incubator comprising:

a base section having an infant support surface adapted to underlie and support an infant, heating and ducting means in said base section, said heating and ducting means having an outlet in the front thereof for delivering heated air and an inlet in the rear thereof for receiving air, said heating and ducting means further including a blower means to force heated air from said outlet at a positive pressure and for inducing air from said inlet, a hood mounted to said base section, said hood having a pair of closely spaced walls forming a flow path for heated air within said walls between said outlet and said inlet, hinge means at the rear of said hood hingedly connecting the rear of said hood to said base section, such that said hood can be moved between an open and a closed position, said hood having an access door in the front of said hood hingedly connected to said base section about a pivot point displaced from said outlet, and having an open and a closed position, said access door comprising a pair of closely spaced walls forming a flow path for air therebetween, said access door in its closed position forming a part of said flow path for air passing from said outlet to said inlet, and in its open position moving clear of said outlet in said base section such that heated air from said outlet passes at a positive pressure across the area occupied by said access door when closed and is induced into said flow path formed by said hood and between said closely spaced walls of said hood to pass to said inlet.

5. An infant incubator as defined in claim 4 wherein said outlet comprises an elongated opening substantially along the width of said hood.

* * * * *